United States Patent [19]

Utagawa et al.

[11] Patent Number: 4,623,766

[45] Date of Patent: Nov. 18, 1986

[54] PRESSURE-SENSITIVE SHEET MATERIAL

[75] Inventors: Ikuo Utagawa, Miyagi; Kazuhiko Ito, Furukawa, both of Japan

[73] Assignee: Alps Electric Co., Ltd., Japan

[21] Appl. No.: 698,563

[22] Filed: Feb. 6, 1985

[30] Foreign Application Priority Data

Jul. 1, 1983 [JP] Japan ..... 58-102266

[51] Int. Cl.[4] ..... H01H 35/00

[52] U.S. Cl. ..... 200/85 R; 200/86 R; 200/275; 339/17 E; 339/176 MF

[58] Field of Search ..... 340/52 E, 666, 667; 307/119; 428/175, 182, 256; 339/17 F, 17 M, 17 LM, 17 E, 176 MF; 200/85 R, 85 A, 86 R, 275, 278, 295, 61.19, 159 B; 174/68.5

[56] References Cited

U.S. PATENT DOCUMENTS

| | | | |
|---|---|---|---|
| 3,795,037 | 3/1974 | Luttner | 339/17 M |
| 3,830,991 | 8/1974 | Durocher | 200/86 R |
| 3,920,940 | 11/1975 | Brown | 200/85 R |
| 3,934,959 | 1/1976 | Gilissen | 339/17 M |
| 4,524,256 | 1/1985 | Miyata | 200/85 R |
| 4,529,959 | 7/1985 | Ito | 200/86 R |

*Primary Examiner*—G. P. Tolin

*Attorney, Agent, or Firm*—Guy W. Shoup

[57] ABSTRACT

A sheet material for a pressure-sensitive detecting device has a corrugated and electrically conductive net having a multiplicity of corrugations on each side thereof and covered by an electrically insulating material. The net is embedded in an electrically insulating material, except for its corrugations which are exposed from the insulating film and the insulating material.

4 Claims, 6 Drawing Figures

PRESSURE-SENSITIVE SHEET MATERIAL

BACKGROUND OF THE INVENTION

1. Field of the Invention:

This invention relates to a pressure-sensitive element which may, for example, be used for detecting the taking of a seat in an airplane or automobile, or for composing an X-Y coordinate input device. More particularly, it is concerned with a sheet material used for making a pressure-sensitive element.

2. Description of the Prior Art:

A known pressure-sensitive element contains electrically conductive particles in an electrically insulating elastic material, such as rubber. If the element is compressed, the conductive particles contact one another to form a path for electric conduction. The removal of the pressure disconnects the particles from one another and brings the element back to its electrically insulated condition. The element usually has a resistance of at least $10^7\Omega$ cm when it is in its insulated condition, and a resistance not exceeding $10^3\Omega$ cm when it is in its conductive condition. This resistance depends on the degree to which the particles approach or contact one another when pressure is applied to the element. The element has, therefore, the disadvantage of having its electrical conductivity depending largely on the pressure applied thereto and being, therefore, unsatisfactory in the reliability and stability of operation.

There is known an X-Y coordinate input device which is called a matrix sheet, and which comprises a pair of substrates formed each with a multiplicity of thin electrodes lying in parallel to one another, and facing each other so that the electrodes on one of the substrates may extend in the X direction, while the electrodes on the other substrate extend in the Y direction which is perpendicular to the X direction, and a pressure-sensitive electrically conductive sheet disposed between the substrates. The electrodes on each substrate are formed by the etching of copper foil bonded thereto. It is necessary for the electrodes to be thin and close to one another in order to improve the dissolution of the device. This requirement gives rise to the breakage of electrodes during their formation by etching and the contact of two or more adjoining electrodes.

There is also known a matrix sheet which comprises a sheet woven from electric wires each covered by an insulating film which is partly removed mechanically as by sandpaper. The mechanical removal of the insulating film is, however, difficult to achieve uniformly. Moreover, it is likely to do damage to the wire surfaces or cause the displacement of the wires.

SUMMARY OF THE INVENTION

Under these circumstances, it is an object of this invention to provide a sheet material for a very reliable pressure-sensitive element which is highly responsive to pressure without developing any appreciable variation in electrical resistance.

This object is attained by a sheet material which comprises a corrugated net formed from electrically conductive wires each covered by an electrically insulating film, and an electrically insulating material in which the net is embedded so that the wires existing along the corrugations of the net may be exposed from the insulating film and material.

The sheet material of this invention is useful not only for making a pressure-sensitive element, but also for other purposes, such as packing.

DETAILED DESCRIPTION OF THE INVENTION

Figure 1:
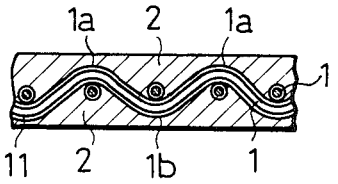
FIGS. 1 to 4 are cross sectional views illustrating a process for making a sheet material embodying this invention.

Referring to FIGS. 1 to 4, a sheet material embodying this invention comprises a corrugated, porous and electrically conductive body 1. More specifically, the body 1 is a net having an opening size of, say, 150 to 250 mesh, and covered by an electrically insulating film 11. The net 1 is formed from wires of, for example, an alloy of copper and zinc, phosphor bronze, phosphor bronze coated with gold, or stainless steel. The insulating film 11 is formed from, for example, enamel. The wires have a diameter of about 50 microns. The net 1 has a thickness of about 120 microns which is a distance between the plane of corrugations 1*a* on one side of the net 1 and the plane of corrugations 1*b* on the other side thereof. A resin 2 exhibiting flexibility upon curing, such as unfoamed silicone rubber, is applied to each side of the net 1 to the extent that it narrowly covers the corrugations 1*a* and 1*b* as shown in FIG. 1. The resin 2 contains thermally expansible microcapsules each comprising, for example, a shell formed from a vinylidene chloride polymer and filled with a hydrocarbon gas having a low boiling point. The microcapsules have a diameter of about 10 to 20 microns, a specific gravity of about 1.13 g/cm$^3$ and a softening point of 80° C. to 85° C. before the resin is foamed.

Figure 2:
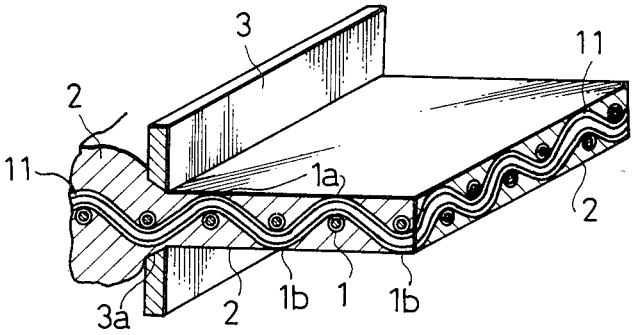
Figure 3:
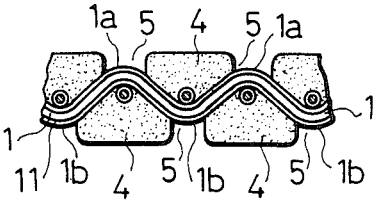
Figure 4:
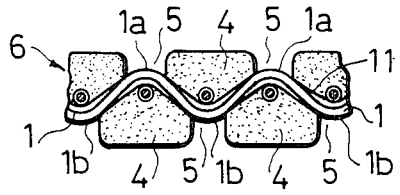

A knife 3 has an opening 3*a* having a width which is substantially equal to the thickness or height of the net 1, and defining a cutting edge. The net 1 covered by the unfoamed resin 2 is forced through the opening 3*a*, as shown in FIG. 2. The knife 3 cuts away extra portions of the resin 2 and thereby exposes the corrugations 1*a* and 1*b* of the net 1 on the surfaces of the resin 2. Then, the resin 2 is foamed by heating and swells to the extent projecting beyond the corrugations 1*a* and 1*b* to form an electrically insulating layer 4 between every two adjoining corrugations on each side of the net 1, as shown in FIG. 3. Every two adjoining insulating layers 4 are spaced apart from each other by a clearance 5 from which a corrugation 1*a* or 1*b* is exposed. The net and resin assembly is, then, immersed in a solution of sodium hydroxide, or any other solution that does not affect the resin, but dissolves the insulating film 11. Alternatively, the solution may be sprayed onto the assembly. This treatment removes the insulating film 11 only from the exposed corrugations 1*a* and 1*b* in the clearances 5. The assembly is carefully washed with water and dried to yield a sheet material 6 as shown in FIG. 4. As a result of the foaming of the resin, the microcapsules have a diameter of about 50 to 60 microns, a specific gravity of about 0.04 to 0.05 g/cm$^3$ and a shell wall thickness of about 0.2 micron.

The insulating layers 4 are independent of each other and excellent in elasticity. Their elasticity can be controlled as required if the foaming conditions are altered appropriately. The presence of the clearances 5 improves the responsiveness of the sheet material 6 to the pressure applied to any insulating layer 4.

No mechanical force is employed for the partial removal of the insulating film, but a solvent is used for that purpose as hereinbefore stated. The net 1 is, therefore, free from any damage or deformation. The insulating film 11 is composed of enamel or any other material having a good affinity for the resin; therefore, the net 1 is strongly bonded to the insulating layers 4. The sheet material of this invention, therefore, maintains a high degree of reliability in performance for a long period of time without experiencing any separation of the insulating layers 4 from the net 1.

Figure 5:
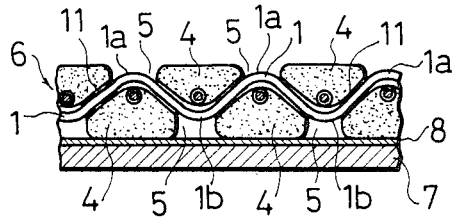
FIG. 5 is a cross sectional view of the sheet material in a condition free from any pressure.
Figure 6:
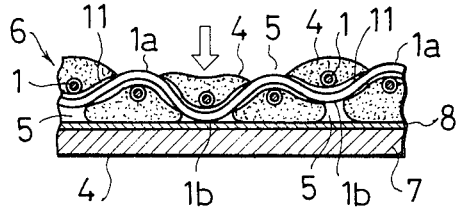
FIG. 6 is a cross sectional view of the sheet material to which pressure has been applied.

The sheet material of this invention may be used, for example, as shown in FIGS. 5 and 6. The sheet material 6 is sandwiched between a pair of substrates 7 each formed from, for example, a phenolic resin and carrying an electrically conductive layer 8 printed on the inner surface thereof. Only the lower substrate 7 and the conductive layer 8 thereon are shown in FIGS. 5 and 6. The conductive layers 8 define a pair of electrodes. The upper electrode not shown is connected to the net 1, but the lower electrode 8 is spaced apart from the net 1 by the insulating layers 4 as shown in FIG. 5. The sheet material 6 is, therefore, in its electrically insulated condition.

If pressure is applied to the assembly as shown by an arrow in FIG. 6, the insulating layers 4 in the vicinity of the point of pressure application are compressed, and the corresponding corrugations 1*b* are brought into contact with the lower conductive layer 8, whereby the two electrodes 8 are electrically connected to each other by the net 1. The removal of the pressure disconnects the net 1 from the lower conductive layer 8 and thereby restores the electrically insulated position of the assembly.

The flexibility of the net 1 and the elasticity of the insulating layers 4 ensure proper restoration of the assembly to its electrically insulated position upon removal of pressure therefrom. These properties and the presence of the clearances 5 enable the assembly to respond to any small amount of pressure to establish an electric detecting circuit. The strong bond between the net 1 and the insulating layers 4, which is due to the insulating film 11, enables the use of the assembly for a long period of repeated operation.

The assembly including the sheet material of this invention is useful for installation in, for example, a seat in an airplane. The weight of a person sitting on the seat may cause the assembly to transmit a signal, and this signal may be used to put on a sign instructing him to fasten his safety belt. The fastening of the belt may be detected electrically, mechanically or optically to put off the sign. This arrangement ensures that nobody fail to fasten his safety belt.

What is claimed is:

1. A pressure sensitive sheet construction for a switch comprising:

a corrugated net of electrically conductive wires formed with a plurality of corrugated portions on each side thereof, the wires being covered with an electrically insulating film except at said corrugated portions where the film is removed so that the wires are outwardly exposed; and an electrically insulating compressible material in which the corrugated net is embedded except at said corrugated portions where the wires of said net are outwardly exposed between surrounding portions of said material.

2. The pressure sensitive sheet construction of claim 1 for use as a pressure detecting device, further comprising a pair of substrates spaced apart in parallel, a pair of electrodes each provided on an inner surface of one of said substrates, the sheet construction being disposed between said electrodes, and said insulating material being compressible under the application of pressure to said substrates to bring the exposed corrugated portions of said net into contact with said electrodes to establish an electrical connection between said electrodes through said net.

3. A sheet material as set forth in claim 6, wherein said insulating material is a foamed resin projecting to some extent beyond said corrugations on each side of said body.

4. A sheet material as set forth in claim 6, wherein said insulating material on each side of said body comprises a plurality of mutually independent layers each disposed between every adjoining two of said corrugations.

* * * * *